US009124013B2

(12) United States Patent
Frushhour et al.

(10) Patent No.: US 9,124,013 B2
(45) Date of Patent: Sep. 1, 2015

(54) ELECTRICAL CONTACT PINS FOR ELECTRICALLY COUPLING ELECTRONIC DEVICES, BATTERIES, AND/OR BATTERY CHARGERS

(71) Applicant: COVIDIEN LP, Mansfield, MA (US)

(72) Inventors: Scott E. M. Frushhour, Boulder, CO (US); Robert B. Smith, Loveland, CO (US)

(73) Assignee: Covidien LP, Mansfield, MA (US)

( * ) Notice: Subject to any disclaimer, the term of this patent is extended or adjusted under 35 U.S.C. 154(b) by 114 days.

(21) Appl. No.: 14/037,772

(22) Filed: Sep. 26, 2013

(65) Prior Publication Data

US 2014/0106626 A1 Apr. 17, 2014

Related U.S. Application Data

(60) Provisional application No. 61/714,584, filed on Oct. 16, 2012.

(51) Int. Cl.
*H01R 13/24* (2006.01)
*H01R 13/08* (2006.01)

(52) U.S. Cl.
CPC ..... *H01R 13/2464* (2013.01); *H01R 13/08* (2013.01)

(58) Field of Classification Search
CPC ..... H01R 13/2428; H01R 11/18
USPC ..... 439/824, 700; 320/107
See application file for complete search history.

(56) References Cited

U.S. PATENT DOCUMENTS

| | | | | |
|---|---|---|---|---|
| 4,686,465 | A * | 8/1987 | Kruger | 324/756.03 |
| 5,456,621 | A * | 10/1995 | Gan | 439/700 |
| 7,227,334 | B2 * | 6/2007 | Yang et al. | 320/107 |
| 7,291,041 | B1 * | 11/2007 | Yang | 439/500 |
| 8,373,430 | B1 * | 2/2013 | Sochor | 324/755.05 |
| 8,905,795 | B2 * | 12/2014 | Kim et al. | 439/700 |

* cited by examiner

*Primary Examiner* — Vanessa Girardi

(57) ABSTRACT

An electrical contact pin includes an outer shaft, an inner shaft at least partially received within the outer shaft and slidable relative to the outer shaft, and a rotatable member disposed at a free end of the inner shaft. The rotatable member is rotatable relative to the inner shaft in at least one direction.

14 Claims, 5 Drawing Sheets

ELECTRICAL CONTACT PINS FOR ELECTRICALLY COUPLING ELECTRONIC DEVICES, BATTERIES, AND/OR BATTERY CHARGERS

CROSS REFERENCE TO RELATED APPLICATION

The present application claims the benefit of and priority to U.S. Provisional Application Ser. No. 61/714,584, filed on Oct. 16, 2012, the entire contents of which are incorporated herein by reference.

BACKGROUND

1. Technical Field

The present disclosure relates to electronic devices, batteries, and/or battery chargers and, more particularly, to electrical contact pins for electrically coupling electronic devices, batteries, and/or battery chargers to one another.

2. Background of Related Art

Battery-powered devices are advantageous in that they obviate the need for cables coupling the device to an electrical outlet or external power source. A typical battery pack for a battery-powered device includes one or more battery cells coupled to one another via a powering circuit that provides electrical power to the device and receives power from a battery charger. Battery packs charge, discharge, and/or communicate with electronic devices and battery chargers through electrical contacts disposed on the exterior of the battery pack that electrically couple to corresponding electrical contacts on the electronic devices and battery chargers. As can be appreciated, damage to the electrical contacts of the battery pack and/or the device or charger to which it connects may inhibit communication, charging, and/or discharging between the battery pack and the device or charger.

SUMMARY

The electrical contact pins provided in accordance with the present disclosure are configured to reduce the oblique forces applied to the electrical contact pins by battery packs, electronic devices, and/or battery chargers during engagement of these components to one another, thereby alleviating stresses on the electrical contact pins and reducing the likelihood of damaging such electrical contact pins during engagement of the battery packs, electronic devices and/or battery chargers to one another.

In accordance with aspects of the present disclosure, an electrical contact pin is provided. The electrical contact pin includes an outer shaft, an inner shaft, and a rotatable member. The inner shaft is at least partially received within the outer shaft and is slidable relative to the outer shaft. The rotatable member is disposed at a free end of the inner shaft and is rotatable relative to the inner shaft in one or more directions.

In aspects, a biasing member is interdisposed between the inner shaft and the outer shaft. The biasing member is configured to bias the inner and outer shafts apart from one another.

In aspects, the rotatable member includes a spherical member disposed at the free end of the inner shaft. The spherical member is rotatable through 360 degrees of rotation relative to the inner shaft.

In aspects, the rotatable member includes one or more wheels disposed at the free end of the inner shaft. The wheel(s) is rotatable relative to the inner shaft.

In accordance with the present disclosure, a battery charging apparatus is provided. The battery charging apparatus includes one or more charging bays. Each charging bay is configured to operably receive a battery assembly therein. One or more electrical contact pins are disposed within each of the charging bays. The electrical contact pin(s) may be configured similarly to any of the aspects described above.

In accordance with the present disclosure, a system is provided. The system includes a battery assembly having one or more electrical contact(s) and a device configured to operably couple to the battery assembly for charging the battery assembly or receiving power from the battery assembly. The device includes one or more electrical contact pins configured to electrically coupled to the electrical contact(s) of the battery assembly. Each of the electrical contact pins may be configured similarly to any of the aspects described above.

The device may include a surgical instrument, a battery charging apparatus, or any other suitable device.

BRIEF DESCRIPTION OF THE DRAWINGS

Various aspects of the present disclosure are described hereinbelow with reference to the drawings, wherein.

DETAILED DESCRIPTION

Figure 1:
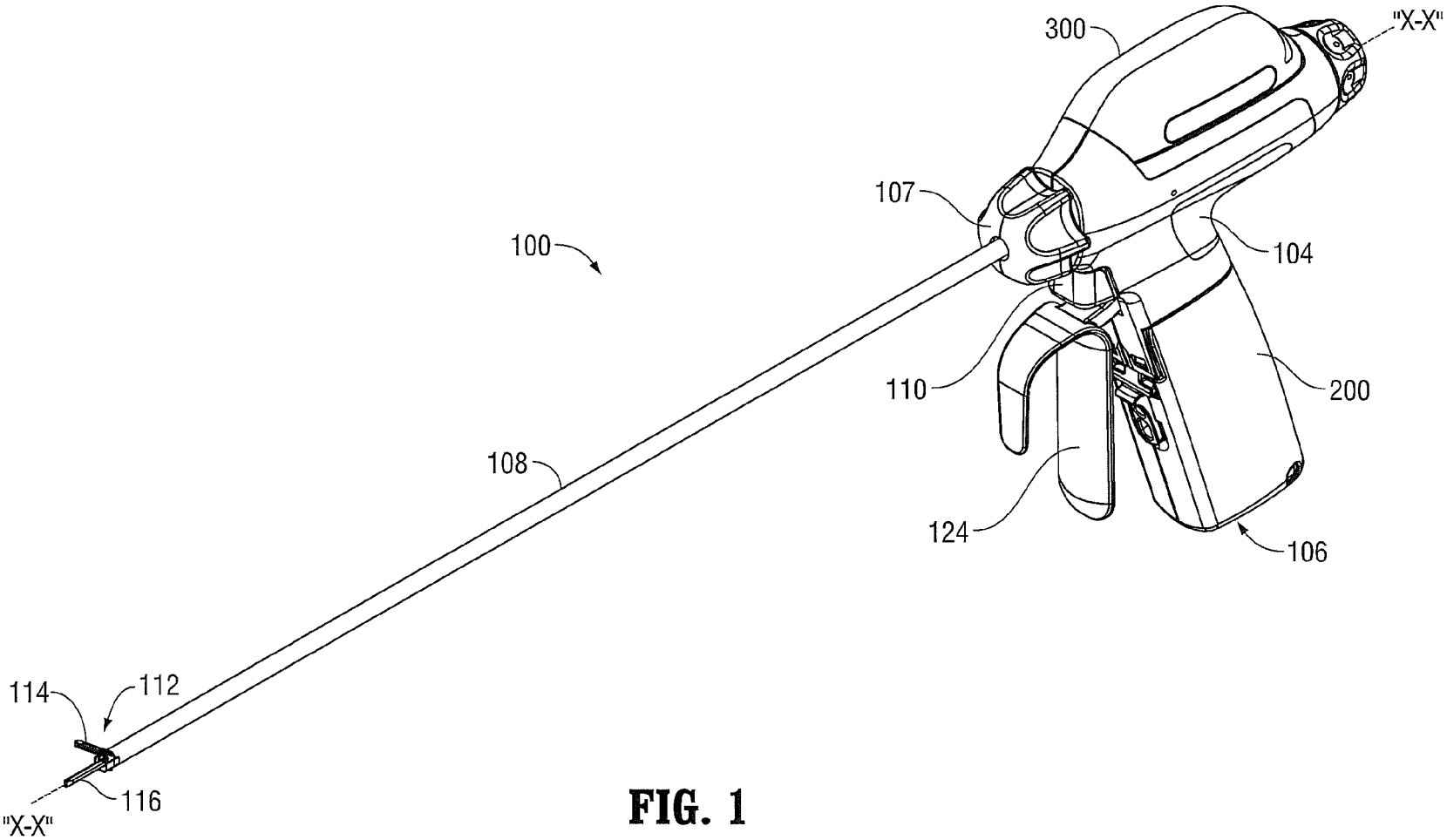
FIG. 1 is a side, perspective view of an exemplary portable, battery-powered surgical instrument configured for use in accordance with the present disclosure.

FIG. 1 depicts a portable, battery-powered surgical instrument 100, although any other suitable battery-powered device, e.g., surgical instrument, handheld tool, electronic device, etc., may be utilized in accordance with the present disclosure. Obviously, different considerations apply to each particular type of device; however, the features and aspects of the present disclosure are equally applicable and remain generally consistent with respect to any suitable battery-powered device. For the purposes herein, surgical instrument 100 is generally described.

Continuing with reference to FIG. 1, surgical instrument 100, shown as an ultrasonic tissue treating device, generally includes a housing 104, a handle assembly 106, a rotating assembly 107, a shaft 108, an activation button 110, an end effector assembly 112, a releasably engagable battery assembly 200, and a releasably engagable generator assembly 300. End effector assembly 112 includes first and second jaw members 114, 116, one or both of which is movable relative to the other, e.g., upon actuation of moveable handle 124, between an open position and a clamping position for grasping tissue therebetween. One of the jaw members, e.g., jaw member 116, is configured to serve as an active or oscillating ultrasonic blade that is selectively activatable to ultrasonically treat tissue grasped between jaw members 114, 116.

Shaft 108 is coupled to housing 104 at a proximal end of shaft 108 and extends distally from housing 104 to define a longitudinal axis "X-X." End effector assembly 112, including jaw members 114, 116, is disposed at a distal end of shaft 108. Housing 104 is configured to releasably engage generator assembly 300 and battery assembly 200. Generator assembly 300 includes a transducer (not shown) configured to convert electrical energy provided by battery assembly 200 into mechanical energy that produces motion at the end of a waveguide, e.g., at jaw member 116. More specifically, the electronics (not shown) of the generator assembly 300 convert the electrical energy provided by battery assembly 200 into a high voltage AC waveform that drives the transducer (not shown). When the transducer (not shown) and the waveguide are driven at their resonant frequency, mechanical motion, e.g., ultrasonic motion, is produced at the active jaw member 116 for treating tissue grasped between jaw members 114, 116. Activation button 110 is disposed on housing 104 and is selectively activatable to operate instrument 100 in two modes of operation: a low-power mode of operation and a high-power mode of operation.

Figure 2A:
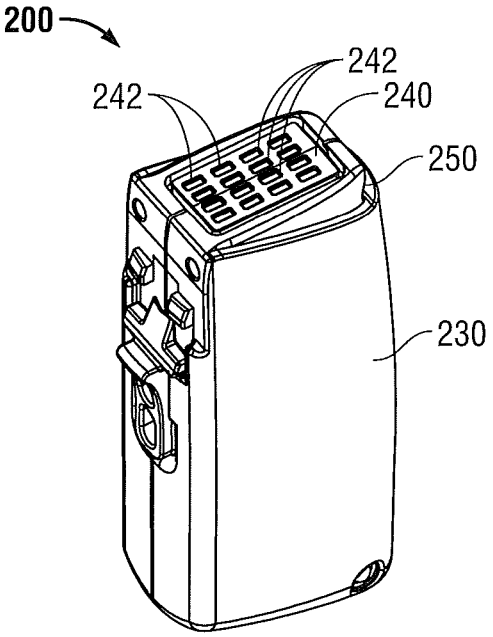
FIG. 2A is a side, perspective view of the battery assembly of the surgical instrument of FIG. 1.
Figure 2B:
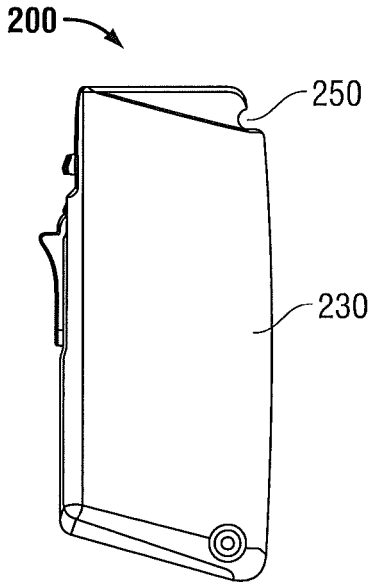
FIG. 2B is a side view of the battery assembly of FIG. 2A.
Figure 2C:
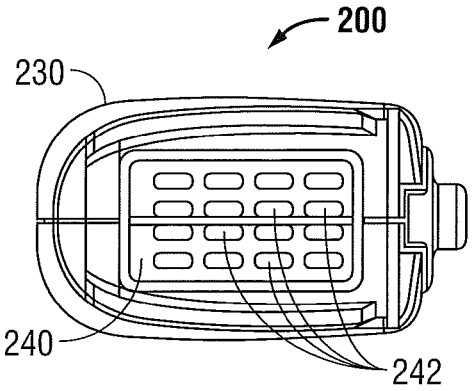
FIG. 2C is a top view of the battery assembly of FIG. 2A.

With reference to FIGS. 2A-2C, battery assembly 200 of surgical instrument 100 (FIG. 1) generally includes an outer housing 230 and a contact cap 240. Outer housing 230 houses the battery pack (not shown) and battery circuitry (not shown) of battery assembly 200, while contact cap 240 provides an interface including a plurality of electrically-conductive electrical contacts 242 for electrically coupling the battery pack (not shown) and battery circuitry (not shown) of battery assembly 200 to surgical instrument 100 (FIG. 1), charging apparatus 400 (FIGS. 3A-3B), or other suitable device. More specifically, electrical contacts 242 are configured to electrically couple to corresponding contacts (not shown) on surgical instrument 100 (FIG. 1) for transmitting power, control signals, and/or communicating with surgical instrument 100 (FIG. 1) and to corresponding electrical contact pins 420 of one of charging bays 410 of charging apparatus 400 (see FIGS. 3A-3B) for charging battery assembly 200 and/or communicating with charging assembly 400. Further, outer housing 230 of battery assembly 200 defines an elongated pivot recess 250 about which battery assembly 200 is rotated into engagement with one of the bays 410 of charging apparatus 400 (FIGS. 3A-3C) such that electrical contacts 242 of battery assembly 200 are electrically coupled to electrical contact pins 420 (FIG. 3C) of charging apparatus 400 (FIGS. 3A-3C), as will be described below. Pivot recess 250 may additionally or alternatively be used to pivot battery assembly 200 into mechanical engagement and electrical communication with surgical instrument 100 (FIG. 1).

Figure 3A:
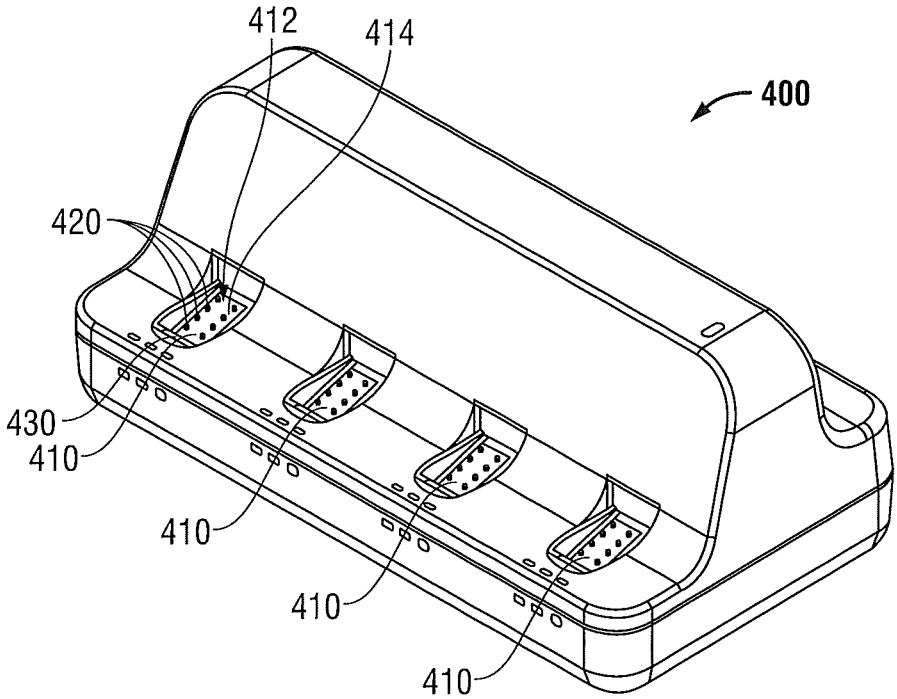
FIG. 3A is a side, perspective view of an exemplary battery charging device configured for use in accordance with the present disclosure.
Figure 3B:
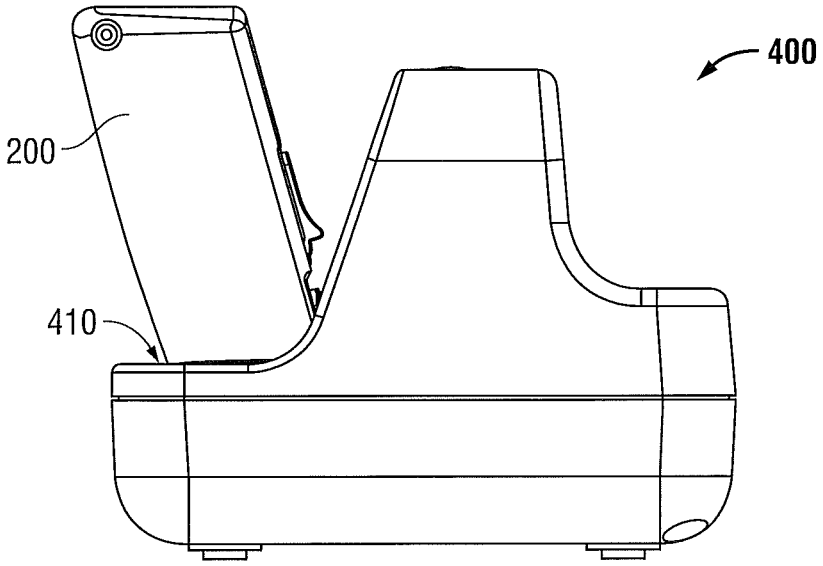
FIG. 3B is a side view of the battery charging device of FIG. 3A having the battery assembly of FIG. 2A operably engaged within a charging bay of the battery charging device.
Figure 3C:
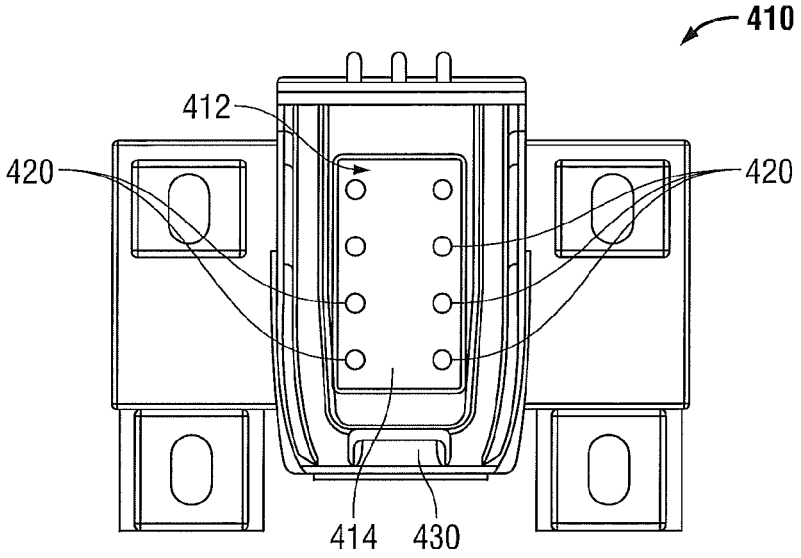
FIG. 3C is a top view of one of the charging bays of the battery charging device of FIG. 3B.

Turning now to FIGS. 3A-3C, in conjunction with FIGS. 2A-2C, charging apparatus 400 is shown including four bays 410, each configured to receive a battery assembly 200 for charging, updating, testing, etc. the battery assembly 200, although greater or less than four bays 410 may also be provided. As best shown in FIG. 3C, each bay 410 defines a recessed portion 412 configured to at least partially receive a battery assembly 200. A base surface 414 of the recessed portion 412 of each bay 410 includes a plurality of electrical contact pins 420 that, as mentioned above, are configured to electrically couple to corresponding electrical contacts 242 of contact cap 240 of battery assembly 200. Various embodiments of electrical contact pins 420, 520, 620 (FIGS. 4A-4B, 5, and 6, respectively) are described below.

Figure 7:
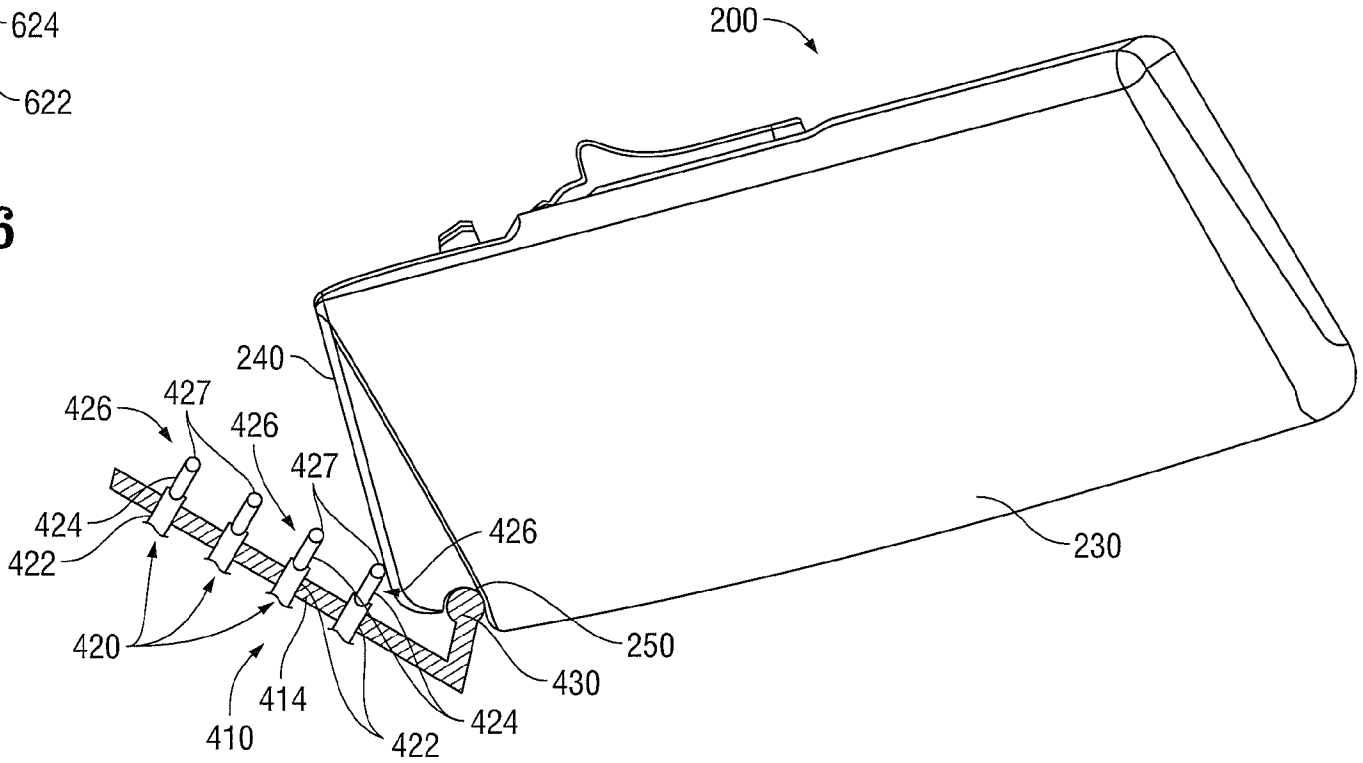
FIG. 7 is partial-side, partial-cross-sectional view showing the battery assembly of FIG. 2A being moved into operable engagement with the electrical contact pins of the battery charging device of FIG. 3A.

Each bay 410 of charging apparatus 400 further includes a pivot bar 430 configured for receipt within pivot recess 250 of battery assembly 200 such that battery assembly 200 may be rotated about pivot recess 250 and pivot bar 430 and into mechanical engagement within recessed portion 412 of bay 410 to electrically couple electrical contacts 242 and electrical contact pins 420 with one another (see FIG. 7). Providing a pivot bar 430 and pivot recess 250 about which battery assembly 200 is rotated to couple battery assembly 200 within one of the bays 410 of charging apparatus 400 facilitates proper alignment and positioning of battery assembly 200 within charging apparatus 400 and, more particularly, proper alignment and positioning of electrical contacts 242 relative to electrical contact pins 420. As such, proper mechanical engagement and electrical connections between battery assembly 200 and charging apparatus 400 are readily established. However, it is also envisioned that battery assembly 200 may be engaged within one of the bays 410 of charging apparatus 400 in any other suitable fashion, e.g., via sliding, direct insertion, etc.

Referring to FIGS. 4, 5A-5B, and 6, in conjunction with FIGS. 2A-3C, various embodiments of electrical contact pins 420 (FIG. 4), 520 (FIGS. 5A-5B), 620 (FIG. 6) are shown configured for use with charging apparatus 400, although electrical contact pins 420 (FIG. 4), 520 (FIGS. 5A-5B), 620 (FIG. 6) may alternatively be provided on battery assembly 200, surgical instrument 100 (FIG. 1), or any other suitable component configured for releasable electrical coupling with another device for charging, discharging, communicating, or otherwise electrically interfacing therewith.

Figure 4:
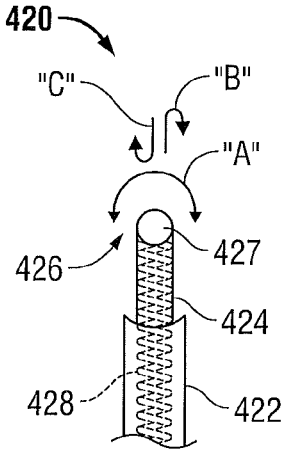
FIG. 4 is a side, cross-sectional view of one embodiment of an electrical contact pin provided in accordance with the present disclosure and configured for use with the battery charging device of FIG. 3A.

With reference to FIG. 4, in conjunction with FIGS. 2A-3C, electrical contact pin 420 is electrically coupled to the internal electronics (not shown), e.g., power, communication, and control circuitry, of charging apparatus 400, and generally includes an electrically-conductive fixed outer shaft 422, an electrically-conductive inner shaft 424 slidably received within and extending from outer shaft 422, a tip portion 426 disposed at the free end of inner shaft 424, and a biasing member 428 that biases inner shaft 424 upwardly and outwardly from outer shaft 422, i.e., towards a less-overlapping configuration. Thus, as one of the electrical contacts 242 of contact cap 240 of battery assembly 200 is urged into electrical contact pin 420 upon engagement of battery assembly 200 within one of the bays 410 of charging apparatus 400, tip portion 426 and inner shaft 424 of electrical contact pin 420 are urged inwardly against the bias of biasing member 428. This configuration allows tip portion 426 to be maintained in contact with the corresponding electrical contact 242 of battery assembly 200 under the bias of biasing member 428, thereby helping to ensure uninterrupted charging and/or communicating between battery assembly 200 and charging apparatus 400.

Tip portion 426 of electrical contact pin 420 includes an electrically-conductive, e.g., gold or gold coated, spherical member 427 disposed at the free end thereof that is permitted to rotate in at least a plurality of directions relative to inner shaft 424, as indicated by arrows "A," "B," and "C" in FIG. 4, although spherical member 427 is not limited to rotation in these directions. Rather, spherical member 427 may be configured to rotate in any suitable combination of directions, or may be configured for 360 degrees of rotation, i.e., spherical member 427 may be rotatable in all directions. Spherical member 427 may be partially captured within the free end of inner shaft 424 (as shown) to permit 360 degrees of rotation, or may be coupled to inner shaft 424 in any other suitable fashion such that spherical member 427 is retained at the free end of inner shaft 424 and is rotatable relative to inner shaft 424 in at least a plurality of directions.

Continuing with reference to FIG. 4, as mentioned above, inner shaft 424 is slidably received within outer shaft 422. More specifically, the outer surface of inner shaft 424 and the inner surface of outer shaft 422 are maintained in electrical communication with one another, e.g., via direct contact or an electrically-conductive lubricant (graphite, grease, etc.) disposed therebetween, regardless of the positioning of inner shaft 424 and outer shaft 422 relative to one another. Spherical member 427 is partially captured at the free end of inner shaft 424 and is likewise maintained in electrical communication with inner shaft 424 in any suitable fashion, e.g., via direct contact or an electrically-conductive lubricant disposed therebetween. As such, contact between spherical member 427 and one of the electrical contacts 242 of battery assembly 200 establishes electrical communication between the battery cells and internal electronics (not shown) of battery assembly 200 and the internal electronics (not shown) of charging apparatus 400.

Figure 5A:
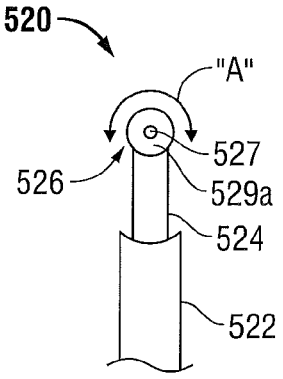
FIG. 5A is a side view of another embodiment of an electrical contact pin provided in accordance with the present disclosure and configured for use with the battery charging device of FIG. 3A.
Figure 5B:
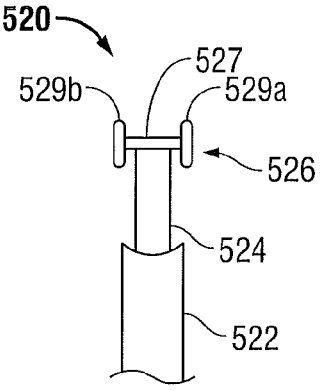
FIG. 5B is a front view of the electrical contact pin of FIG. 5A.

Turning to FIGS. 5A-5B, another embodiment of an electrical contact pin configured for use with for use with charging apparatus 400, battery assembly 200 (FIGS. 2A-2C), surgical instrument 100 (FIG. 1), or any other suitable component, is shown designated by reference numeral 520. Electrical contact pin 520, similar to electrical contact pin 420 (FIG. 4), includes an inner shaft 524 slidably received within and biased apart from a fixed outer shaft 522. However, electrical contact pin 520 differs from electrical contact pin 420 (FIG. 4) with respect to the configuration of tip portion 526. Accordingly, for purposes of brevity, only tip portion 526 of electrical contact pin 520 will be detailed hereinbelow.

Tip portion 526 of electrical contact pin 520 includes a crossbar 527 mounted to the free end of inner shaft 524 and extending transversely relative to inner shaft 524. Crossbar 527 includes one or more wheels 529*a*, 529*b* rotatably mounted thereto. For example, as shown in FIG. 5B, first and second wheels 529*a*, 529*b* may be mounted at opposed ends of cross bar 527, although greater or fewer wheels 529*a*, 529*b* and/or different configurations of wheels 529*a*, 529*b* are also contemplated. Wheels 529*a*, 529*b* are configured to rotate about crossbar 527, as indicated by arrows "A" in FIG. 5A. Crossbar 527 and wheels 529*a*, 529*b* are formed from an electrically-conductive material, e.g., gold (or may be coated with gold or other suitable electrically-conductive material), and are maintained in electrical communication with one another, e.g., via direct contact or an electrically-conductive lubricant disposed therebetween. As such, contact between wheels 529*a*, 529*b* and one of the electrical contacts 242 of battery assembly 200 (see FIGS. 2A-2C) establishes electrical communication between the battery cells and internal electronics (not shown) of battery assembly 200 (FIGS. 2A-2C) and the internal electronics (not shown) of charging apparatus 400 (FIGS. 3A-3C).

Figure 6:
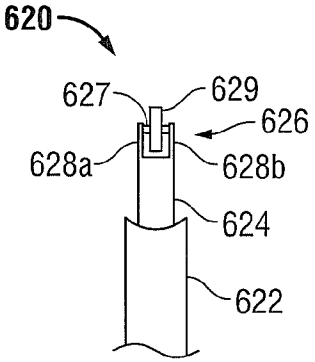
FIG. 6 is a front view of another embodiment of an electrical contact pin provided in accordance with the present disclosure and configured for use with the battery charging device of FIG. 3A.

Turning to FIG. 6, another embodiment of an electrical contact pin configured for use with for use with charging apparatus 400, battery assembly 200 (FIGS. 2A-2C), surgical instrument 100 (FIG. 1), or any other suitable component, is shown designated by reference numeral 620. Electrical contact pin 620, similar to electrical contact pin 520 (FIGS. 5A-5B), includes an inner shaft 624 slidably received within and biased apart from a fixed outer shaft 622. However, electrical contact pin 620 differs from electrical contact pin 520 (FIGS. 5A-5B) with respect to the configuration of tip portion 626. Accordingly, for purposes of brevity, only tip portion 626 of electrical contact pin 620 will be detailed hereinbelow.

Tip portion 626 of electrical contact pin 620 includes a pair of spaced-apart supports 628*a*, 628*b* extending from the free end of inner shaft 624. A wheel 629 is rotatably mounted between supports 628*a*, 628*b* of inner shaft 624 via an axle 627 that extends between supports 628*a*, 628*b*. Wheel 629, axle 627, and supports 628*a*, 628*b* are formed from an electrically-conductive material, e.g., gold (or may be coated with gold or other suitable electrically-conductive material), and are maintained in electrical communication with one another, e.g., via direct contact or an electrically-conductive lubricant disposed therebetween. As such, contact between wheel 629 and one of the electrical contacts 242 of battery assembly 200 (see FIGS. 2A-2C) establishes electrical communication between the battery cells and internal electronics (not shown) of battery assembly 200 (FIGS. 2A-2C) and the internal electronics (not shown) of charging apparatus 400 (FIGS. 3A-3C).

Turning now to FIG. 7, the operation of electrical contact pin 420 during engagement of battery assembly 200 within one of the bays 410 of charging apparatus 400 is described, although the following is similarly applicable to electrical contact pin 520 (FIGS. 5A-5B), and/or for engagement between any suitable electrical components having one or more electrical contacts and one or more corresponding electrical contact pins configured to electrically couple to one another.

As shown in FIG. 7, in order to engage battery assembly 200 within bay 410 of charging apparatus 400, battery assembly 200 is first approximated relative to bay 410 such that pivot recess 250 receives pivot bar 430, thereby establishing a pivot point about which battery assembly 200 can be rotated into engagement within bay 410 of charging apparatus 400. With pivot bar 430 disposed within pivot recess 250, battery assembly 200 is rotated towards electrical contact pins 420, which extend from base surface 414 of recessed portion 412 of bay 410. As battery assembly 200 is rotated further, battery assembly 200, lead by contact cap 240, eventually contacts one or more of the electrical contact pins 420 of bay 410. More specifically, battery assembly 200 is eventually urged into contact with one or more spherical members 427 of tip portions 426 of electrical contact pins 420 at an oblique angle relative thereto. The normal component of force, e.g., the force perpendicular to a plane defined by spherical members 427 of electrical contact pins 420, applied to electrical contact pins 420 by battery assembly 200 causes spherical members 427 and inner shafts 424 to retract into their respective outer shafts 422, against the bias of biasing member 428 (FIG. 4). On the other hand, at least a portion of the non-normal components of force acting on spherical members 427 are transferred into rotational motion of spherical members 427 relative to their respective inner shafts 424, thereby alleviating torque and stress on electrical contact pins 420.

As can be appreciated, the direction of rotation of spherical members 427 corresponds to the direction of the applied force. Since spherical member 427 are permitted to rotate through 360 degrees of rotation in the exemplary embodiment of FIGS. 4A-4B and 7, spherical members 427 are able to alleviate at least a portion of the torque and stress on electrical contact pins 420 for any non-normal force acting on electrical contact pins 420. Thus, although battery assembly 400 is shown and described herein as being engaged within bay 410 of charging apparatus 400 via rotation in a single direction, electrical contact pins 420 are equally capable of alleviating at least a portion of the torque and stress acting thereon for engagement of one component, e.g., battery assembly 200, to another component, e.g., charging apparatus 400, in any other suitable fashion, e.g., via sliding, direct insertion, etc.

Referring to FIGS. 5A-5B, in conjunction with FIG. 7, with respect to electrical contact pins 520, since wheels 529*a*, 529*b* are limited to rotation about a single axis, e.g., about crossbar 527, wheels 529*a*, 529*b* are capable of alleviating at least a portion of the torque and stress on electrical contact pins 420 for the non-normal forces (with respect to the plane defined by tip portions 526 of electrical contact pins 520) that are normal to the rotation axis of wheels 529*a*, 529*b*. Thus, with respect to rotation of battery assembly 200 about a pivot point for engagement with charging apparatus 400, aligning the rotation axis of wheels 529*a*, 529*b* in parallel orientation relative to the pivot point of battery assembly 200 allows for the alleviation of torque and stress on electrical contact pins 520 imparted thereon by battery assembly 200.

While several embodiments of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

What is claimed is:

1. An electrical contact pin, comprising:

an outer shaft;

an inner shaft at least partially received within the outer shaft and slidable relative to the outer shaft, the inner shaft defining a longitudinal axis; and a rotatable member disposed at a free end of the inner shaft, the rotatable member configured to establish direct electrical communication with a corresponding contact, wherein the rotatable member is rotatable through 360 degrees relative to the inner shaft at least about an axis perpendicular to the longitudinal axis so as to reduce the application of oblique forces to the inner shaft.

2. The electrical contact pin according to claim 1, further comprising a biasing member interdisposed between the inner shaft and the outer shaft, the biasing member configured to bias the inner and outer shafts apart from one another.

3. The electrical contact pin according to claim 1, wherein the rotatable member includes a spherical member disposed at the free end of the inner shaft, the spherical member rotatable through 360 degrees relative to the inner shaft about a plurality of axes including the perpendicular axis.

4. The electrical contact pin according to claim 1, wherein the rotatable member includes at least one wheel disposed at the free end of the inner shaft, the at least one wheel rotatable through 360 degrees relative to the inner shaft about the perpendicular axis.

5. A battery charging apparatus, including:

at least one charging bay, each charging bay configured to operably receive a battery assembly therein; and at least one electrical contact pin disposed within each of the charging bays, the at least one electrical contact pin including:

an outer shaft;

an inner shaft at least partially received within the outer shaft and slidable relative to the outer shaft, the inner shaft defining a longitudinal axis; and a rotatable member disposed at a free end of the inner shaft, the rotatable member configured to establish direct electrical communication with a corresponding contact, wherein the rotatable member is rotatable through 360 degrees relative to the inner shaft at least about an axis perpendicular to the longitudinal axis so as to reduce the application of oblique forces to the inner shaft.

6. The battery charging apparatus according to claim 5, wherein the at least one electrical contact pin further comprises a biasing member interdisposed between the inner shaft and the outer shaft, the biasing member configured to bias the inner and outer shafts apart from one another.

7. The battery charging apparatus according to claim 5, wherein the rotatable member of the at least one electrical contact pin includes a spherical member disposed at the free end of the inner shaft, the spherical member rotatable through 360 degrees relative to the inner shaft about a plurality of axes including the perpendicular axis.

8. The battery charging apparatus according to claim 5, wherein the rotatable member of the at least one electrical contact pin includes at least one wheel disposed at the free end of the inner shaft, the at least one wheel rotatable through 360 degrees relative to the inner shaft about the perpendicular axis.

9. A system, comprising:

a battery assembly including at least one electrical contact; and a device configured to operably couple to the battery assembly for charging the battery assembly or receiving power from the battery assembly, the device including at least one electrical contact pin configured to electrically coupled to the at least one electrical contact of the battery assembly, each electrical contact pin including:

an outer shaft;

an inner shaft at least partially received within the outer shaft and slidable relative to the outer shaft, the inner shaft defining a longitudinal axis; and a rotatable member disposed at a free end of the inner shaft, the rotatable member configured to establish direct electrical communication with the at least one electrical contact, wherein the rotatable member is rotatable through 360 degrees relative to the inner shaft at least about an axis perpendicular to the longitudinal axis so as to reduce the application of oblique forces to the inner shaft.

10. The system according to claim 9, wherein the at least one electrical contact pin further comprises a biasing member interdisposed between the inner shaft and the outer shaft, the biasing member configured to bias the inner and outer shafts apart from one another.

11. The system according to claim 9, wherein the rotatable member of the at least one electrical contact pin includes a spherical member disposed at the free end of the inner shaft, the spherical member rotatable through 360 degrees relative to the inner shaft about a plurality of axes including the perpendicular axis.

12. The system according to claim 9, wherein the rotatable member of the at least one electrical contact pin includes at least one wheel disposed at the free end of the inner shaft, the at least one wheel rotatable through 360 degrees relative to the inner shaft about the perpendicular axis.

13. The system according to claim 9, wherein the device is a surgical instrument.

14. The system according to claim 9, wherein the device is a battery charging apparatus.

* * * * *